US006691355B1

(12) United States Patent
Liu

(10) Patent No.: US 6,691,355 B1
(45) Date of Patent: Feb. 17, 2004

(54) MATTRESS MEANS AS SYNERGETICALLY EFFECTED BY DUAL-FLUID FLUIDIZING UNITS

(76) Inventor: Tsung-Hsi Liu, 6 Floor, No. 10, Lane 137, Chang-Chun Road, Taipei (TW)

( * ) Notice: Subject to any disclaimer, the term of this patent is extended or adjusted under 35 U.S.C. 154(b) by 0 days.

(21) Appl. No.: 10/412,023

(22) Filed: Apr. 11, 2003

(51) Int. Cl.[7] ..... A47C 27/10; A61G 7/057

(52) U.S. Cl. ..... 5/714; 5/710; 5/713; 5/681; 5/685; 5/655.5; 5/909

(58) Field of Search ..... 5/714, 713, 710, 5/681, 685, 909, 655.5, 724, 423

(56) References Cited

U.S. PATENT DOCUMENTS 5,564,142 A * 10/1996 Liu ..... 5/710
5,651,151 A * 7/1997 Schild ..... 5/710
5,727,270 A * 3/1998 Cope et al. ..... 5/710
6,148,461 A * 11/2000 Cook et al. ..... 5/713

* cited by examiner

*Primary Examiner*—Alexander Grosz

(57) ABSTRACT

A mattress device includes a plurality of dual-fluid fluidizing units juxtapositionally secured in a mattress envelope; each dual-fluid fluidizing unit consisting of a lower air cell and an upper gel (or gel-like) cell superimposed and secured on the lower air cell, having a plurality of flexible ventilating and baffling tubes formed through each upper gel cell for venting air from the lower air cell to the patient's body as lying on the upper gel cells for therapeutically treating the patient as synergetically effected by both the air and gel cells.

5 Claims, 4 Drawing Sheets

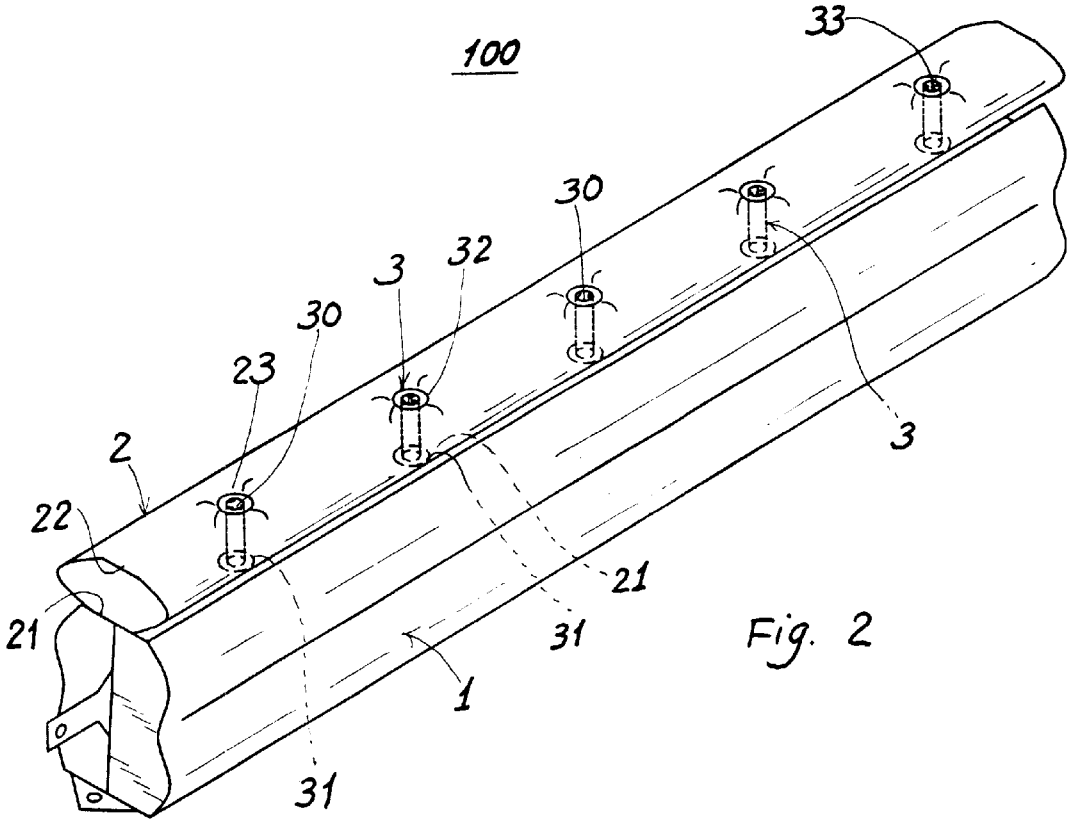
Fig. 2
Fig. 3
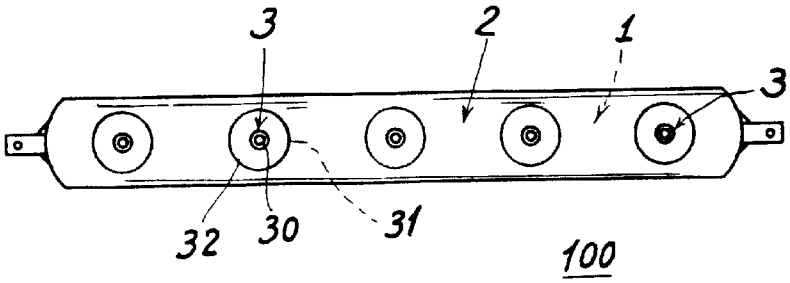

MATTRESS MEANS AS SYNERGETICALLY EFFECTED BY DUAL-FLUID FLUIDIZING UNITS

BACKGROUND OF THE INVENTION

A conventional air mattress provides an internal ventilation system by supplying ventilating air to a patient. Pressure points along the patient's body may be periodically relieved while simultaneously receiving conditioned air to thereby comfort the patient. Since air is thermally isulative with poor heat conductivity, the air mattress is unsatisfactory for therapeutically treating those burn patients.

Water bed or gel-filled mattress may then be recommended for cooling and comforting the burn patients. However, when the patient lies down on the water or gel bed, the interface in between the patient's body and the bed can not be well ventilated with air. The accumulation of moisture between the patient and the bed may cause or deteriorate the pressure ulcer of the patient.

The present inventor has found the drawbacks of the conventional mattress, and invented the present mattress means provided with both gel and air cells.

SUMMARY OF THE INVENTION

The object of the present invention is to provide a mattress device including a plurality of dual-fluid fluidizing units juxtapositionally secured in a mattress envelope or encasement; each dual-fluid fluidizing unit consisting of a lower air cell and an upper gel (or gel-like) cell superimposed and secured on the lower air cell, having a plurality of flexible ventilating and baffling tubes formed through each upper gel cell for venting air from the lower air cell to the patient's body as lying on the upper gel cells for therapeutically treating the patient as synergetically effected by both the air and gel cells.

BRIEF DESCRIPTION OF THE DRAWINGS

FIG. 2 is a perspective view of each dual-fluid fluidizing unit.

FIG. 3 is a top view of the fluidizing unit.

DETAILED DESCRIPTION

Figure 1:
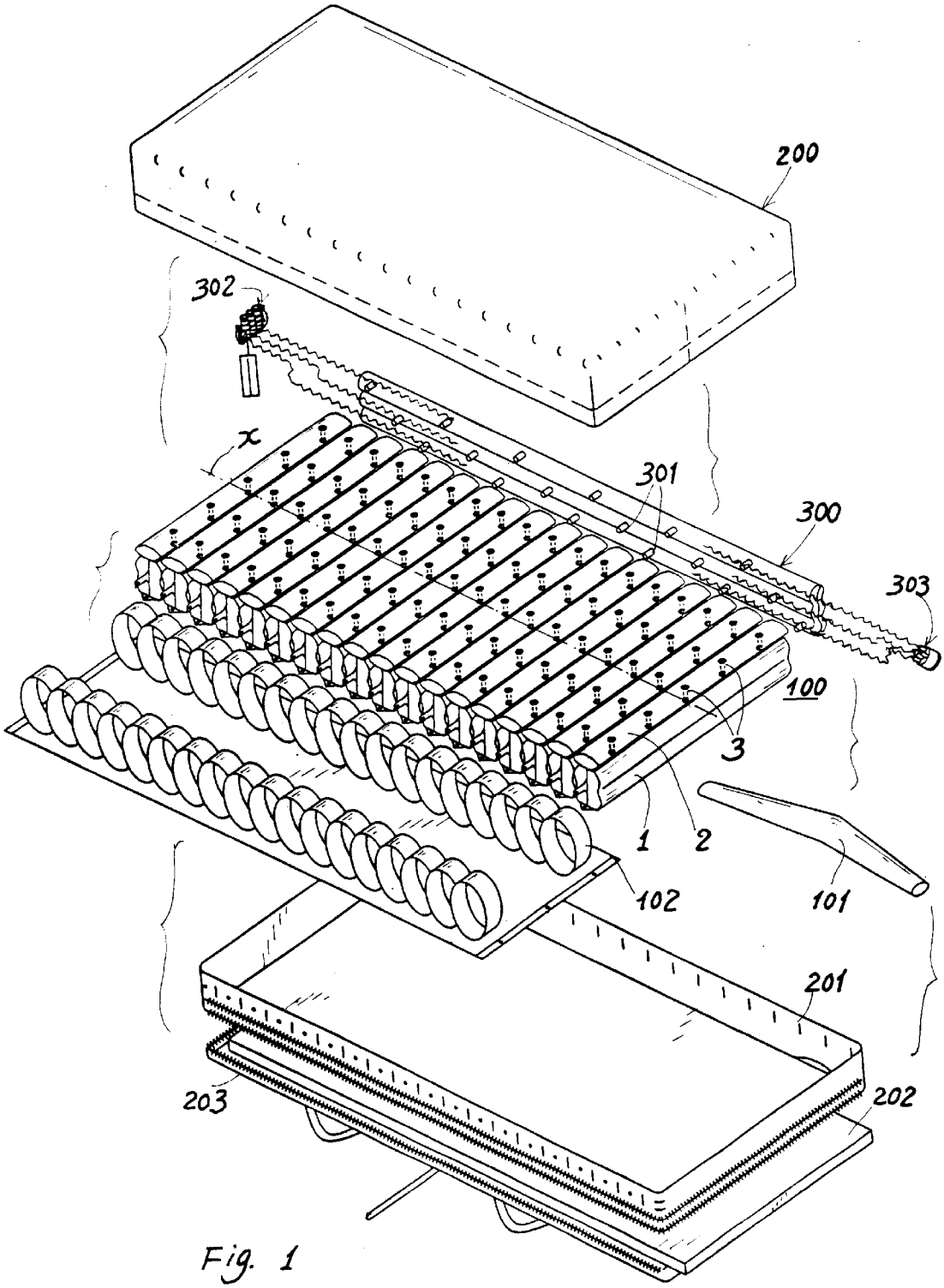
FIG. 1 is an exploded view showing the elements of the present invention.
Figure 4:
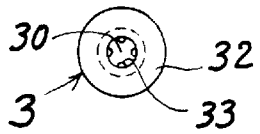
FIG. 4 is a top view of a ventilating and baffling tube formed in the fluidizing unit.
Figure 5:
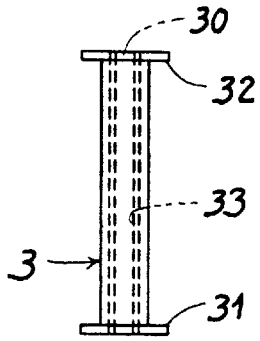
FIG. 5 is an elevational view of the ventilating and baffling tube.
Figure 6:
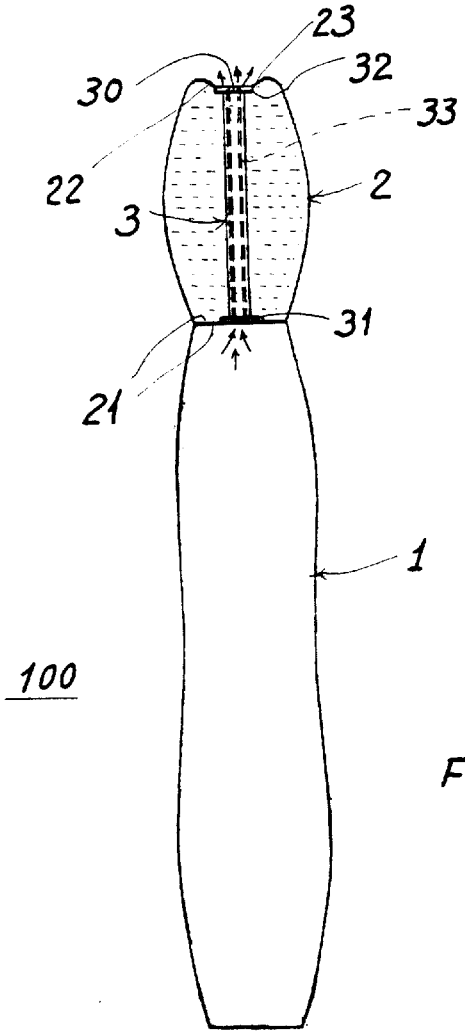
FIG. 6 is a side-view sectional drawing of the fluidizing unit.
Figure 7:
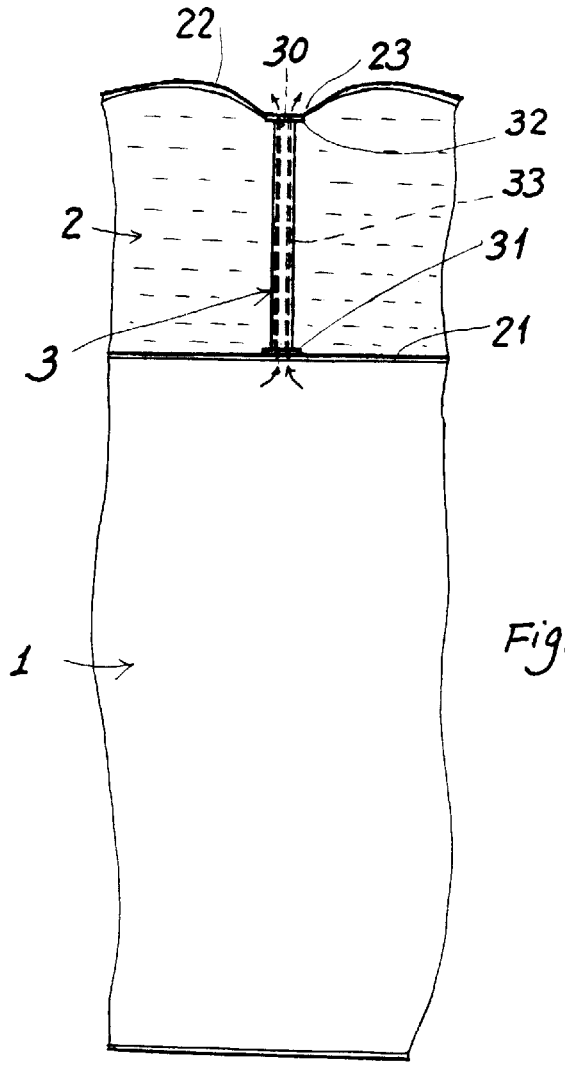
FIG. 7 is a partial sectional drawing of the fluidizing unit as viewed from a direction perpendicular to that of FIG. 6.

As shown in the drawing figures, the mattress means (or device) of the present invention comprises: a plurality of dual-fluid fluidizing units 100 juxtapositionally secured in a mattress envelope or encasement 200, each fluidizing unit 100 generally perpendicular to a longitudinal axis X defining at a longitudinal center of the mattress means of the present invention.

Each dual-fluid fluidizing unit 100 includes: a lower air cell 1 inflated with air therein (or deflating air therefrom); an upper gel cell 2 superimposed and secured on the lower air cell 1 and filled with gel (or gel-like colloidal solution or viscous liquid) in the upper gel cell 1; and a plurality of flexible ventilating and baffling tubes 3 longitudinally formed through the upper gel cell 2, each ventilating and baffling tube 3 retained between a bottom layer 21 and an upper layer 22 of the upper gel cell 2 and fluidically communicated with the lower air cell 1. Each fluidizing unit may be formed as arch or arcuate shape, but not limited in this invention.

Each flexible ventilating and baffling tube 3 includes: a lower flange 31 secured or integrally formed (such as by integral forming, adhesive bonding or other joining methods) with the bottom layer 21 of the upper gel cell 2; an upper flange 32 secured or integrally formed with the upper layer 22 of the upper gel cell 2; an air passage 30 formed through a central portion of the tube 3 to fluidically communicate with the lower air cell 1 for venting air from the lower air cell 1 to an interface in between the upper layer 22 and a patient's body (not shown) lying on the upper layer 22 of the upper gel cell 2, and a plurality of ribs 33 longitudinally formed on an inside wall of the air passage 30 within the tube 3.

Each flange 31 or 32 of the tube 3 is firmly bonded and absolutely sealed to the upper and bottom layers 22, 21 of the upper gel cell 2 to prevent from any leakage of air and gel between the tube 3 and the cell 2.

The tube 3 is made of flexible materials including rubber, plastic or any other materials having better elasticity and flexibility.

The upper gel cell 2 includes an upper port 23 recessed in the upper layer 22 to communicate with an upper opening of the air passage 30 of the tube 3.

Figure 8:
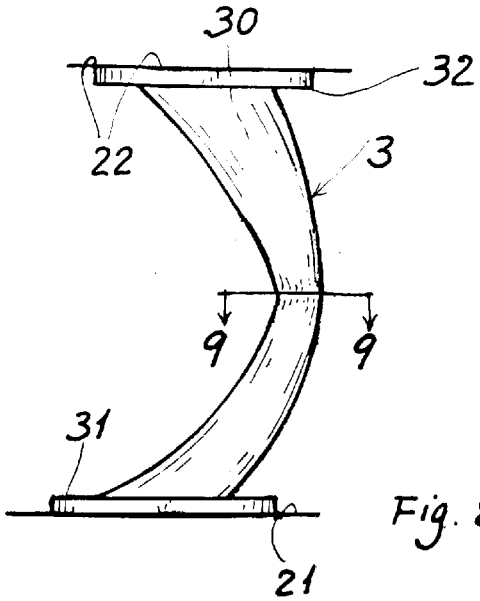
FIG. 8 shows a bent ventilating and baffling tube of the present invention.
Figure 9:
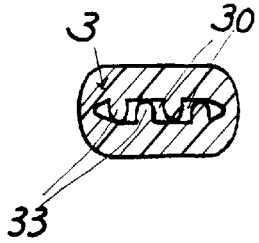
FIG. 9 is a cross sectional drawing as viewed from section 9—9 of FIG. 8.

The ventilating and baffling tube 3 plays a very important role in the present invention with the following features and advantages:

1. The tube 3 will deliver air from the lower air cell 1 to the surface of the upper gel cell 2 for ventilating and comforting the patient lying on the upper cell 2 to overcome the drawback of non-ventilation of conventional water or gel bed in which no air tube is straightly formed through the water or gel layer.
2. The tube 3 is formed in situ to be a baffle (without additionally forming baffles in the gel cell) in the gel fluid within the upper gel cell 2 to restrict a free flow of gel within the cell to thereby enhance a sound positioning, re-positioning, well-balance immersion, efficient pressure reduction and releasing for the patient as lying on the mattress means.
3. The ribs 33 provided in each tube 3 may prevent from buckling or "dogging" to still maintain a minimal air passage 30 as shown in FIGS. 9, 8 when the tube is accidentally bent, thereby always keeping a continuous air ventilation towards the patient.
4. The ribs 33 as formed in the tube 3 may decrease the cross sectional area of the central air passage 30 within the tube to substantially reduce the air delivery volumetric rate from each lower air cell 1 to the environment adjacent the patient's body, thereby causing low air loss of the complete air supply or distribution system of the present invention.

This is an unobvious merit of the present invention, even by combining the conventional air mattress and gel (or water) bed, to provide the ventilating and baffling tubes 3 in the upper gel cells 2 to simultaneously "enjoy" the advantages of gel mattress (by upper cells 2) and of air mattress (by lower cells 1). Namely, a synergetic effect may be obtained by the air and gel cells of the present invention.

As shown in FIG. 1, each dual-fluid fluidizing unit 100 may be jacketed into a sleeve 101 and fastened to the mattress means by a belt set 102. All the fluidizing units 100 as received in the sleeves will be covered by the envelope 200 and respectively supplied with fluids by the header or manifold 300 having adapters or connectors 301.

The envelope 200 further includes: a middle cover 201, a sponge set 202 and a bottom 203 as shown in FIG. 1. A valve system 302 and CPR device 303 may also be provided in the present invention. Since these elements are so conventional and not described in detail in this invention.

The lower air cells 1 may be alternatively inflated or deflated periodically. The inflated air cells support the patient's body; while the deflated air cells not supporting the rest of the body, whereby the redistribution of the patient's body weight and relief of his or her pressure points may be achieved by such an alternating system.

An electronic micro-processed controller with powerful air output capacity may be provided to achieve a continuous air flow into the lower cells, through the tubes 3 in the gel or gel-like cell 2, to ventilate and comfort the user.

Meanwhile, reviewing the primary cause of pressure ulcers such as constant or excessive pressure to a bony prominence when soft tissue is compressed between bony prominence and an external surface for a prolonged period of time to thereby develop the pressure ulcers; and other causes for pressure ulcers, such as: shear, caused by tissue layers sliding with each other to thereby produce stretching and angulation of the arteries distributed to the skin; moisture, excess moisture on intact skin developing a potential source of maceration which in turn causes pressure ulcers; and friction, resulted from skin rubbing against a contact surface to cause abrasion; all the above factors to cause the pressure ulcers may be prevented by the present invention with the following brief reasons:

1. The physical forces caused by excess pressure, shear and friction will be greatly released and reduced by the gel cells 2 as cushioned on the air cells 1 of the present invention.
2. The moisture will be minimized as "purged" by the air as vented through the tubes 3 to be laden in the air.

So, the pressure ulcers may be effectively prevented by the present invention.

Accordingly, a compact portable mattress means (overlay/replacement pad) as synergetically effected by air cells and gel or gel-like cells, with low air loss, satisfactory alternating press, and optimum pressure reduction or relief may be obtained in accordance with the present invention.

The present invention may be modified without departing from the spirit and scope of the present invention.

If the fluidity factor as required is not so critical, the gel cells 2 may also be substituted with water cells for filling water in the cells 2.

I claim:

1. A mattress means comprising:

a plurality of dual-fluid fluidizing units juxtapositionally secured in a mattress envelope; each said dual-fluid fluidizing unit including: a lower air cell having air inflated therein; an upper gel cell superimposed and secured on the lower air cell and filled with gel in the upper gel cell; and a plurality of flexible ventilating and baffling tubes longitudinally formed through each said upper gel cell, each said ventilating and baffling tube retained between a bottom layer and an upper layer of the upper gel cell and fluidically communicated with the lower air cell for venting air from said lower air cell through said upper gel cell towards a patient lying down on said upper gel cell.

2. A mattress means according to claim 1, wherein each said flexible ventilating and baffling tube includes: a lower flange formed with the bottom layer of the upper gel cell; an upper flange formed with the upper layer of the upper gel cell, an air passage formed through the tube to fluidically communicate with the lower air cell for venting air from the lower air cell to an interface in between the upper layer and a patient's body lying on the upper layer of the upper gel cell, and a plurality of ribs longitudinally formed on an inside wall of the air passage within the tube.

3. A mattress means according to claim 1, wherein said mattress means further includes an air supply system operatively alternatively inflating or deflating the lower air cells of said fluidizing units.

4. A mattress means according to claim 1, wherein said upper gel cell is formed with a plurality of upper ports each recessed in an upper layer of said upper gel cell to be communicated with an air passage formed in each said tube.

5. A mattress means comprising: a plurality of dual-fluid fluidizing units juxtapositionally secured in a mattress envelope; each said dual-fluid fluidizing unit including: a lower air cell having air inflated therein; an upper water cell superimposed and secured on the lower air cell and filled with water in the upper water cell; and a plurality of flexible ventilating and baffling tubes longitudinally formed through each said upper water cell, each said ventilating and baffling tube retained between a bottom layer and an upper layer of the upper water cell and fluidically communicated with the lower air cell for venting air from said lower air cell through said upper water cell towards a patient lying down on said upper water cell.

* * * * *